US005586804A

United States Patent [19]

Burroughs

[11] Patent Number: 5,586,804

[45] Date of Patent: Dec. 24, 1996

[54] BEVERAGE CONTAINER HOLDER FOR A FOLDING CHAIR

[75] Inventor: Richard H. Burroughs, Green Bay, Wis.

[73] Assignee: Krueger International, Inc., Green Bay, Wis.

[21] Appl. No.: 492,236

[22] Filed: Jun. 19, 1995

[51] Int. Cl.[6] ..... A47C 7/62

[52] U.S. Cl. ..... 297/188.08; 297/188.21

[58] Field of Search ..... 297/188.08, 188.21, 297/188.01, 188.15, 411.37, 411.31, 411.2, 422.32, 188.05, 16.1, 31; 403/116, 117, 113; 248/311.2, 313, 315

[56] References Cited

U.S. PATENT DOCUMENTS

| | | | |
|---|---|---|---|
| 409,887 | 8/1889 | Walker | 248/315 X |
| 879,489 | 2/1908 | Pokorny | 297/188.08 X |
| 1,202,978 | 10/1916 | Dyke | 248/315 X |
| 1,221,658 | 4/1917 | Berry | 248/311.2 X |
| 1,962,575 | 6/1934 | Silverman | 248/315 X |
| 2,202,365 | 5/1940 | Zeman | 248/311.2 |
| 2,690,950 | 10/1954 | Nordmark | 248/315 X |
| 3,784,142 | 1/1974 | O'Brien | 248/311.2 |
| 4,561,796 | 12/1985 | Hanaoka | 403/116 X |
| 4,848,840 | 7/1989 | Toya | 297/411.32 |
| 5,413,400 | 5/1995 | Llanes | 297/16.1 |

*Primary Examiner*—Milton Nelson, Jr.
*Attorney, Agent, or Firm*—Andrus, Sceales, Starke & Sawall

[57] ABSTRACT

A beverage container holder for use with an article of furniture such as a chair includes a base connected to the seat of the chair and a container holder member pivotably mounted to the base. The container holder member includes an outer portion having an opening for receiving a beverage container, an inner portion pivotably connected to the base, and a connector portion extending between the outer portion and the inner portion. The container holder member is pivotable between a storage position in which the outer portion is disposed below the seat, and an operative position in which the outer portion is located exteriorly of the seat. Stop structure is interposed between the base and the container holder member for limiting the range of pivoting movement of the container holder member from its storage position to its operative position. Preferably, the stop structure includes an arcuate slot formed in the inner mounting portion of the container holder member, and a stud extending through the slot. The container holder member can be moved to any desired position between engagement of the stud with the slot ends.

18 Claims, 1 Drawing Sheet

BEVERAGE CONTAINER HOLDER FOR A FOLDING CHAIR

BACKGROUND AND SUMMARY OF THE INVENTION

This invention relates to an assembly for holding a beverage container, and more particularly to a beverage container holder for use in combination with an item of furniture such as a chair.

The occupant of a chair often finds himself or herself in a situation where the occupant is holding a beverage container but has nowhere to place the container to free his or her hands. In a setting in which a number of chairs are placed side-by-side, the occupant can place the container on the seat of an adjacent chair if the chair is unoccupied. If the adjacent chairs are occupied, however, the occupant may have to place the beverage container on the floor beneath or near the chair. Either of these situations can easily result in the beverage being spilled.

It is an object of the present invention to provide a beverage container holder for a chair or seat assembly, which is a part of the chair or seat assembly itself. It is a further object of the invention to provide such a beverage container holder which can be moved out of the way to a storage position when not in use. It is a further object of the invention to provide a beverage container holder which is simple in construction and operation, and which can easily be adapted for use in combination with a chair. A still further object of the invention is to provide a beverage container holder which is particularly well suited for use in combination with a chair having a seat frame and a seat member which cooperates to define a downwardly facing recess, such as a conventional folding chair.

In accordance with one aspect of the invention, a beverage container holder for a seat assembly having a seat defining an outer peripheral edge includes a container holder member and a movable mounting arrangement interconnected with the seat assembly and with the container holder member. The container holder member includes a first portion having structure for receiving a beverage container, and a second portion spaced from the first portion and movably interconnected with the mounting arrangement for providing movement of the first portion of the container holder member between a storage position and an operative position. In the storage position, the first portion of the container holder member is located inwardly of the peripheral edge of the seat, and in the operative position is located outwardly of the seat peripheral edge. The structure for receiving a beverage container may be in the form of a ring-like member defining an opening through which the beverage container extends. The ring-like member may include a tab for manual engagement by a user to facilitate movement of the container holder member between its storage and operative positions. The container holder member is preferably mounted so as to be pivotably movable between its storage and operative positions. Preferably, the second portion of the container holder member includes an arcuate slot, and a fixed-position control member is secured to the seat and extends through the slot. Engagement of the control member with the ends of the slot controls the range of pivoting movement of the container holder member. The radius of the slot extends from a center, and the second portion of the container holder member is pivotably mounted via a connector which is coincident with the center of the slot for providing pivoting movement of the container holder member relative to the seat. In a preferred form, the container holder member is a plate-like member having the ring structure formed on one end thereof, disc-like mounting structure formed at the opposite end thereof and securable to the seat via the connector defining the pivot axis, and a connector section extending between the ring structure and the disc-like structure. The seat includes a frame which cooperates with the seat to define a downwardly facing recess or interior space below the seat member, and the container holder member is pivotably mounted to a base member secured within the recess. The base is constructed and arranged such that the container holder member is located slightly below the frame member.

The invention further contemplates a folding chair having a beverage container holder constructed and arranged as summarized above.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
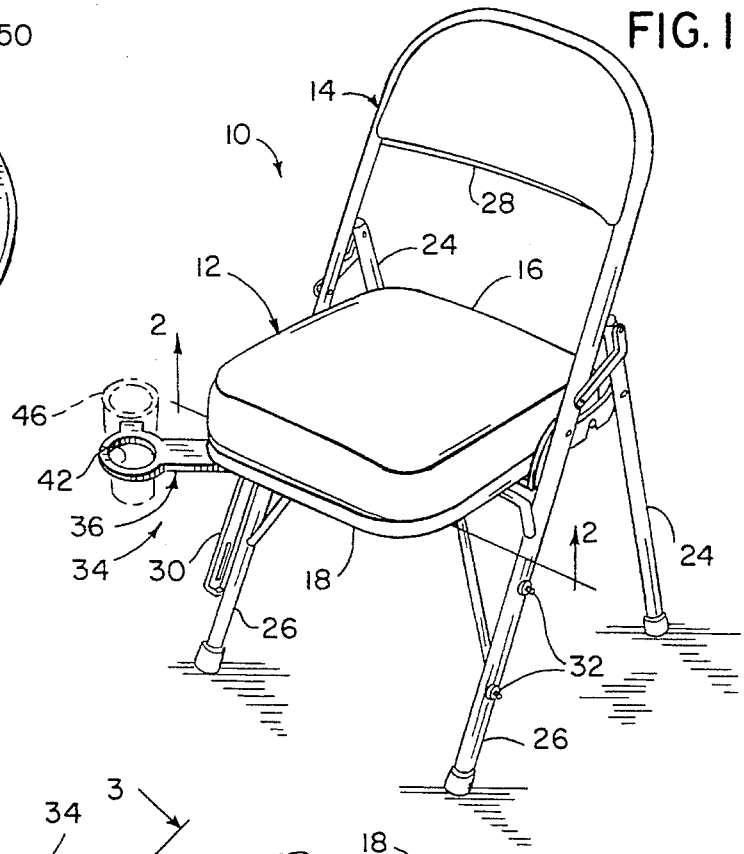
FIG. 1 is an isometric view of a folding chair having a beverage container holder constructed according to the invention mounted to its seat assembly.

Referring to FIG. 1, a folding chair 10 generally includes a seat assembly 12 and a back assembly 14, in accordance with conventional construction. Folding chair 10 forms no part of the present invention, but is shown and described to illustrate the environment in which the present invention is employed.

Seat assembly 12 includes a seat member 16 mounted to a seat frame 18. Seat member 16 includes a cushion 20 (FIG. 3) mounted to a support member 22, such as a wooden board or any other satisfactory support structure for securing seat cushion 20 to frame 18.

A pair of legs 24 are pivotably mounted to seat assembly 12 via conventional leg mounting structure. Back assembly 14 is an inverted U-shaped member defining a pair of legs 26 and a back 28 at its upper end. Again, back assembly 14 is pivotably connected to seat assembly 12 via conventional mounting structure. As is known, folding chair 10 is movable to an open, use position as shown in FIG. 1 and a collapsed, storage position in which seat assembly 12 is pivoted such that its front portion is moved upwardly and rearwardly and its rear portion is moved downwardly and forwardly, to bring legs 24 and 26 together.

Folding chair 10 may be adapted for use in a ganged installation, in which each chair includes a bracket 30 mounted to one of its legs 26 and pins 32 mounted to the other of its legs. Pins 32 are received within slots formed in bracket 30 of an adjacent chair, for interconnecting the chairs together in a manner as is known. Chairs of this type are often used in convention centers, meeting rooms or other environments where many people can be seated at the same time.

Figure 2:
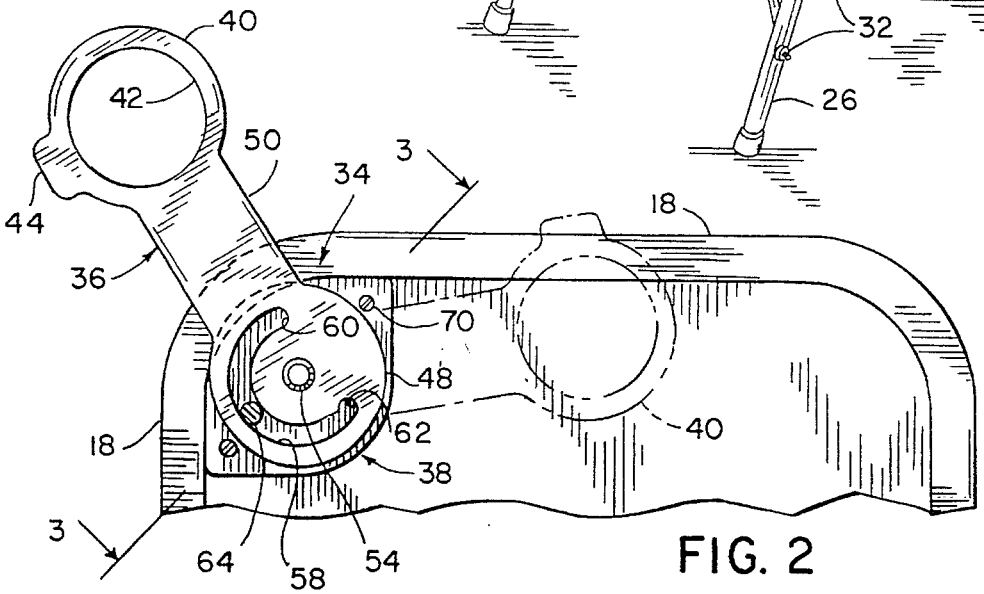
FIG. 2 is a partial bottom plan view of the front portion of the seat of the folding chair of FIG. 1, reference being made to line 2—2 of FIG. 1.
Figure 3:
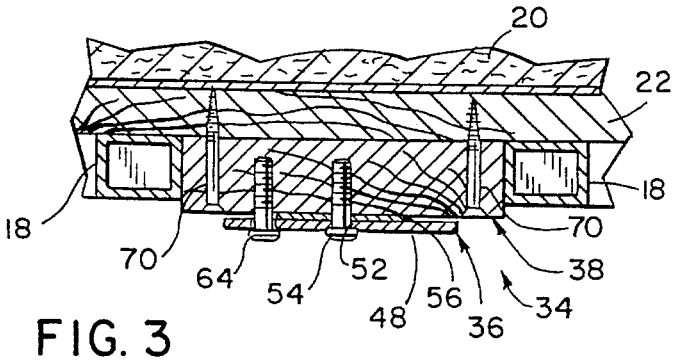
FIG. 3 is a partial section view taken along line 3—3 of FIG. 2.

Referring to FIGS. 1–3, a beverage container holder assembly 34, constructed according to the invention, is mounted to seat assembly 12. Referring to FIG. 2, beverage container holder assembly 34 generally consists of a container holder member 36 and a base 38.

Container holder member 36 includes a ring-like outer portion 40 defining a central opening 42. A tab 44 is formed integrally with outer portion 40. As shown in FIG. 1, a beverage container 46, shown in phantom, can extend through opening 42 such that the inwardly facing edge of ring-like outer portion 40 engages the tapered outer side wall of container 46 for supporting container 46.

Container holder member 36 further includes an inner, disc-like mounting portion 48, and a connector section 50 extending between outer portion 40 and inner portion 48.

Container holder member 36 is formed of a thin, light weight material which has sufficient strength to support a filled beverage container. For example, container holder member 36 may be constructed of a material such as 11 gauge steel meeting CRS commercial quality, ASTM A36 Class 1.

Referring to FIGS. 2 and 3, disc-like inner mounting portion 48 includes a central aperture 52 through which the shank of a fastener 54 extends into base 38. Fastener 54 also extends through an opening defined by a washer 56 positioned between base 38 and inner mounting portion 48. With this arrangement, container holder member 36 is pivotably mounted to base 38 for movement about a pivot axis defined by the longitudinal axis of fastener 54.

Inner mounting portion 48 further includes an arcuate slot 58 defining spaced ends 60, 62. Slot 58 defines a radius having its center coincident with the longitudinal axis of fastener 54. The shank of a stud 64 extends through slot 58 and into base 38.

The head of stud 64 engages the lower surface of mounting portion 48 of container holder member 36, which provides a two-point support for inner mounting portion 48 to relieve stress which would otherwise be solely experienced by fastener 54 when container 46 is received within opening 42.

Figure 4:
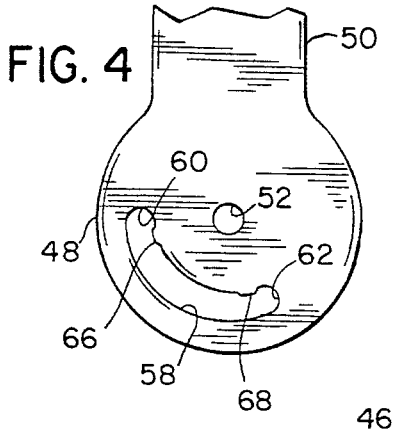
FIG. 4 is an enlarged partial bottom plan view showing the mounting portion of the container holder member for the beverage container holder of FIG. 1.

Referring to FIG. 4, protrusions 66, 68 are formed in the inner wall of slot 58 adjacent slot ends 60, 62, respectively.

As shown in FIGS. 2 and 3, base 38 is secured to seat support member 22 via threaded screws 70 which extend through base 38 and into support member 22. When support member 22 and base 38 are constructed of a material such as wood, a glue or other satisfactory adhesive is preferably placed between base 38 and the underside of support member 22 before mounting base 38 to support member 22 using screws 70, to securely mount base 38 to support member 22. It is understood, however, that any satisfactory means could be employed to mount base 38 to support member 22, regardless of the material from which base 38 and support member 22 are constructed.

Base 38 is positioned within a corner defined by seat frame 18, and includes side edges which engage the inwardly facing edges of frame 18 for providing consistent positioning of base 38 relative to frame 18. As shown in FIG. 3, base 38 has a depth slightly greater than that of frame 18, such that its lower surface is spaced slightly below the lower surface of frame 18. With this arrangement, container holder member 36 is spaced slightly below the lower surface of frame 18 when mounted to base 38.

In operation, beverage container holder assembly 34 functions as follows. Prior to use, container holder member 36 is placed in its storage position as shown in phantom at FIG. 2, in which outer portion 40 is disposed below seat assembly 12 within the periphery defined by seat frame 18. In this position, tab 44 is visible from above by the user, and preferably carries indicia such as "PULL FOR DRINK HOLDER" to advise the user that beverage container holder assembly 34 is available for use. If desired, the user then grasps tab 44 to move container holder member 36 away from its storage position to an operative position, in which outer portion 40 is positioned outwardly of seat frame 18. When moving container holder member 36 away from its storage position, stud 64 passes over protrusion 68, which releasably maintains container holder member 36 in its storage position. The user can place container holder member outer portion 40 in any desired position according to user requirements and comfort. Container holder member 36 is movable between a forwardly-oriented position in which outer portion 40 is located slightly off-center from the longitudinal front-rear axis of seat 16 and just forwardly of the front edge of seat frame 18, and a side-oriented position in which outer portion 40 is located adjacent and outwardly of the side of seat frame 18, and laterally of seat 16. When in the side-oriented fully-open position, protrusion 66 releasably engages the shank of stud 64 for maintaining container holder member 36 in this position. It can be appreciated, however, that slot 58 and stud 64 enable container holder member 36 to be moved to any position between its storage and fully-open positions, as desired.

To return container holder member 36 to its storage position, the user removes his or her beverage container 46 from outer portion 40 and places container holder member 36 back in its storage position in which outer portion 40 is disposed below seat assembly 12 within the boundary defined by frame 18. Protrusion 68 passes the shank of stud 64 for releasably maintaining container holder member 36 in its storage position.

Washer 56 provides a bearing surface for the upper surface of mounting portion 48 of container holder member 36 during movement of container holder member 36 between its operative and storage positions.

Various alternatives and embodiments are contemplated as being within the scope of the following claims particularly pointing out and distinctly claiming the subject matter regarded as the invention.

I claim:

1. A combination beverage container holder and seat assembly including a seat defining an outer peripheral edge, comprising:

a container holder member having a first portion including structure for receiving a beverage container, and a second portion spaced from the first portion; and a movable mounting arrangement secured to the seat, and located inwardly of the outer peripheral edge of the seat, the movable mounting arrangement being interconnected with the second portion of the container holder member for providing pivoting movement about a substantially vertical pivot axis for moving of the first portion of the container holder member between a storage position in which the first portion is located inwardly of the seat peripheral edge, and an operative position in which the first portion is located outwardly of the seat peripheral edge.

2. The combination beverage container holder and seat assembly of claim 1, wherein the container holder member comprises a plate-like member, wherein the first portion of the container holder member comprises a ring structure defined by the plate-like member having an opening for receiving a container, and wherein the second portion of the container holder member comprises a disc-like structure defined by the plate-like member securable to the seat via a connector defining a pivot axis about which the container holder member is pivotably movable, and wherein the plate-like member further defines a connector section extending between the ring structure and the disc-like structure.

3. The combination beverage container holder and seat assembly of claim 1, wherein the first portion of the container holder member comprises a ring-like member defining an opening for receiving a beverage container.

4. The combination beverage container holder and seat assembly of claim 3, further comprising a tab extending from the ring-like member for manual engagement by a user to facilitate movement of the first portion of the container holder member between its storage and operative positions.

5. The combination beverage holder and seat assembly of claim 4, wherein the movable mounting arrangement and the second portion of the container holder member are constructed and arranged such that the tab is positioned outwardly of the seat outer peripheral edge when the first portion of the container holder member is in its storage position.

6. The combination beverage container holder and seat assembly of claim 1, wherein the movable mounting arrangement includes an arcuate slot formed in the second portion of the container holder member, the slot defining first and second ends, and a fixed-position control member secured to the seat and extending through the slot, wherein engagement of the control member with the first and second ends of the slot controls the range of pivoting movement of the container holder member.

7. The combination beverage container holder and seat assembly of claim 6, wherein the seat defines an underside, and wherein the control member is secured to a base mounted to the underside of the seat and positioned inwardly of the seat peripheral edge, and wherein the second portion of the container holder member is pivotably mounted to the base.

8. The combination beverage container holder and seat assembly of claim 7, wherein the radius of the arcuate slot extends from a center, and wherein the second portion of the container holder member is pivotable about a substantially vertical pivot axis coincident with the center of the slot.

9. The combination beverage container holder and seat assembly of claim 8, wherein the second portion of the container holder member is pivotably mounted to the base via a connector extending through the second portion of the container holder member into the base, wherein the connector defines the vertical pivot axis.

10. A combination beverage container holder and seat assembly, the seat assembly including a frame member and a seat mounted to the frame member, wherein the frame member and the seat cooperate to define an internal space on an underside of the seat assembly comprising:

a base mounted to the underside of the seat assembly within the internal space; and a plate-like container holder member pivotably mounted to the base and including an outer portion defining structure for receiving a beverage container, wherein the plate-like container holder member is pivotable between a storage position in which a majority of the outer portion is disposed below the seat assembly and an operative position in which the outer portion is located exteriorly of the seat assembly for providing access to the outer portion by a user seated upon the seat assembly.

11. The combination beverage container holder and seat assembly of claim 10, wherein the seat includes a rigid support member secured to the frame member, and wherein the base is mounted to the support member adjacent the frame member.

12. The combination beverage container holder seat assembly of claim 11, wherein the base and the plate-like container holder member are constructed and arranged such that the plate-like container holder member is located slightly below the frame member.

13. The combination beverage container holder and seat assembly of claim 10, wherein the plate-like container holder member includes an inner mounting portion pivotably mounted to the base.

14. The combination beverage container holder and seat assembly of claim 13, further comprising stop structure interposed between the base and the inner mounting portion for controlling the range of pivoting movement of the plate-like container holder member between its storage and operative positions.

15. The combination beverage container holder and seat assembly of claim 14, wherein the stop structure includes an arcuate slot formed in the inner mounting portion of the plate-like container holder member and a stop member mounted to the base and extending through the slot.

16. A folding chair, comprising:

a seat assembly including a frame member and a seat mounted to the frame member, the seat defining a peripheral edge;

a back assembly;

wherein the seat assembly and the back assembly are collapsibly interconnected with each other for providing movement of the seat and the back assemblies between a collapsed, storage position and an open, use position;

a beverage container holder assembly, comprising a mounting member mounted to the seat assembly, and a container holder member including an outer container holding portion and an inner mounting portion movably secured to the mounting member for providing pivoting movement of the container holder member between a storage position in which a majority of the outer container holding portion is located inwardly of the seat peripheral edge, and an operative position in which the container holding portion is located outwardly of the seat peripheral edge; and wherein the frame member and the seat cooperate to define a downwardly facing recess within which the mounting member is located.

17. The folding chair of claim 16, wherein the mounting member is secured to the seat assembly adjacent the frame member, and wherein the container holder member comprises a plate-like member located adjacent the frame member for movement below the frame member between its operative and storage positions.

18. The folding chair of claim 17, wherein the plate-like member is pivotably mounted to the mounting member, and further comprising stop structure interposed between the plate-like member and the mounting member for controlling the range of pivoting movement of the platelike member between its operative and storage positions.

* * * * *

UNITED STATES PATENT AND TRADEMARK OFFICE
CERTIFICATE OF CORRECTION

PATENT NO. : 5,586,804

DATED : December 24, 1996

INVENTOR(S) : RICHARD H. BURROUGHS

It is certified that error appears in the above-identified patent and that said Letters Patent is hereby corrected as shown below:

On title page, item

[56] References Cited, add: -- U.S. Patent 2,639,762, 5/1953, Westcamp --.

In The Claims

Claim 10, column 5, line 54, after "assembly" insert -- , --.

Signed and Sealed this

Twentieth Day of May, 1997

*Attest:*

Bruce Lehman

BRUCE LEHMAN

*Attesting Officer*

*Commissioner of Patents and Trademarks*

UNITED STATES PATENT AND TRADEMARK OFFICE
Certificate

Patent No. 5,586,804

Patented: December 24, 1996

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of the patent is: Richard H. Burroughs, Scott A. Bosman and Thomas H. Vollrath.

Signed and Sealed this Sixth Day of March, 2001.

PETER M. CUOMO
*Supervisory Patent Examiner*
Art Unit 3636